US006863160B2

(12) United States Patent
Lauch

(10) Patent No.: US 6,863,160 B2
(45) Date of Patent: Mar. 8, 2005

(54) SERVICE BARRIER

(75) Inventor: Richard Lauch, Hopatcong, NJ (US)

(73) Assignee: Inventio AG, Hergiswil (CH)

( * ) Notice: Subject to any disclaimer, the term of this patent is extended or adjusted under 35 U.S.C. 154(b) by 132 days.

(21) Appl. No.: 10/423,663

(22) Filed: Apr. 25, 2003

(65) Prior Publication Data

US 2004/0211629 A1 Oct. 28, 2004

(51) Int. Cl.[7] ..... B66B 13/14
(52) U.S. Cl. ..... 187/314; 187/332; 187/280
(58) Field of Search ..... 187/277, 280, 187/301, 308, 310, 900, 313–325, 332, 333

(56) References Cited

U.S. PATENT DOCUMENTS

| | | | | | |
|---|---|---|---|---|---|
| 415,848 | A | * | 11/1889 | Schlesser | 187/326 |
| 925,456 | A | * | 6/1909 | Christensen | 187/332 |
| 1,993,285 | A | * | 3/1935 | Sigmund | 187/332 |
| 6,202,800 | B1 | * | 3/2001 | Muller et al. | 187/401 |
| 6,691,833 | B1 | * | 2/2004 | Elsener et al. | 187/266 |
| 6,739,432 | B2 | * | 5/2004 | Elsener | 187/401 |
| 2001/0022253 | A1 | | 9/2001 | Reuter et al. | |

FOREIGN PATENT DOCUMENTS

| | | | | | |
|---|---|---|---|---|---|
| EP | 897 372 | | | 2/1999 | |
| GB | 2158038 | A | * | 11/1985 | E04G/1/26 |
| JP | 54108333 | A | * | 8/1979 | B66B/13/28 |
| JP | 02291377 | A | * | 12/1990 | B66B/5/00 |
| JP | 04140294 | A | * | 5/1992 | B66B/11/02 |
| JP | 05043162 | A | * | 2/1993 | B66B/7/00 |
| JP | 05097357 | A | * | 4/1993 | B66B/11/02 |
| JP | 06156922 | A | * | 6/1994 | B66B/7/00 |

* cited by examiner

*Primary Examiner*—Jonathan Salata
(74) *Attorney, Agent, or Firm*—Ostrolenk, Faber, Gerb & Soffen, LLP

(57) ABSTRACT

A service barrier for elevator equipment and a method for deploying the same, said barrier comprising a floor plate and a plurality of leaves hinged along vertical axes, said floor plate pivotally mounted in front of said elevator equipment and at least one of said plurality of hinged leaves mounted to a side of said elevator equipment, wherein the floor plate is pivotal from a stored position to a substantially horizontal extended position, and said plurality of hinged leaves fold out from a stored position between said stored floor plate and said elevator equipment to an extended position thereby establishing a space in front of said elevator equipment so as to permit maintenance work.

16 Claims, 3 Drawing Sheets

SERVICE BARRIER

BACKGROUND OF THE INVENTION

1. Field of the Invention

The present invention relates to a service barrier for elevator equipment. More particularly, the invention relates to a service barrier consisting of an expansible structure mounted on said elevator equipment or alternatively mounted to a room containing said equipment.

2. Discussion of the Prior Art

As is known, the construction of elevator installations for passengers and goods is regulated by specific standards which require that, among other things, a suitable room be provided for containing the electrical control cabinet and machinery, or power unit that powers the cage movement. The standards also specify that during maintenance of such equipment a further space should be provided for the technician to carry out the required maintenance work in safety.

The provision of a permanent maintenance safety space is in direct conflict with the requirements of customers who generally desire the elevator system to occupy the least space possible. Furthermore there has been a tendency within the industry to install all elevator equipment in the shaft rather than providing a dedicated machine room.

A number of prior art proposals have been suggested to provide a temporary safety space that is established only when maintenance is to be carried out. Such a system has been described in EP-B-0897372 wherein the equipment is contained in a room having an access door formed from three hinged leaves. The vertically hinged leaves can be unfolded and orientated at right angles to each other to create a rectangular partially enclosed space in front of the room, thereby establishing the required safety space for the maintenance technician.

In an increasing number of installations, the room containing the equipment is accessed directly from a hallway of the building. In many instances the hallway will have a floor covering (carpet, wooden flooring, marble flooring etc.). If the enclosure of EP-B-0897372 is used, degradation of the floor covering is inevitable through the repeated unfolding and folding of the hinged leaves across the covering. Furthermore, since the temporary safety space extends from the room into the hallway, there is also a high likelihood that debris and dirt from the technician's maintenance activities will also degrade the floor covering.

Additionally, it is questionable whether the leaves from the prior art are sufficiently stable since in the unfolded arrangement (creating the safety space) they are supported only at the extremities by opposing walls of the room, no fixings or supports being provided at the intermediate sections in the hallway. It is easy to envisage that any force applied to the leaves from the hallway would cause the rectangular safety space to skew, which could potentially trap and injure the technician for whom the safety space was devised.

Before working on electrical equipment the technician must ensure that he/she sufficiently grounded. This is normally achieved by a grounding strap that the technician affixes around his wrist. Naturally, this requirement hampers the technician's manual dexterity in carrying out the required work.

The object of the present invention is to avoid the inconveniences recited in the foregoing.

More particularly, the object of the present invention is to provide a service barrier for containing elevator equipment, said barrier occupying very little space in a stored position but providing sufficient space for maintenance work when in an extended position.

A further object of the invention is to provide a service barrier containing structure which accommodates all necessary equipment in a single room to achieve an easy and timesaving maintenance.

BRIEF SUMMARY OF THE INVENTION

These and still other objects of the invention are achieved with a service barrier for elevator equipment, comprising a floor plate and a plurality of leaves hinged along vertical axes, wherein the floor plate is movable from a stored position to a substantially horizontal extended position, and said plurality of hinged leaves fold out from a stored position between said stored floor plate and said elevator equipment to an extended position on top of said extended floor plate thereby establishing a space in front of said elevator equipment so as to permit maintenance work.

Accordingly, the barrier provides a safe workspace for a technician during maintenance and also protects any pedestrian traffic external to said workspace from the technician and the elevator equipment he may be maintaining. Said extended floor plate protects any existing flooring underneath during maintenance activity and also serves as an appropriate place for the technician to rest and stage his tools during maintenance. Furthermore, if said flooring is carpet then the floor plate also prevents static transfer to the technician.

Preferably said floor plate is pivotally mounted in front of said elevator equipment and at least one of said plurality of hinged leaves is mounted to a side of said elevator equipment. This compact arrangement provides a logical, easy-to-use and unitary barrier system which a technician can easily deploy, even without instructions, by merely extending the component parts in the sequence in which they are presented.

Preferably said floor plate in said stored position prevents access to said elevator equipment. Hence a technician must deploy said barrier even for the smallest of tasks thereby minimizing the risk of accident or damage to members of the public and flooring.

Preferably the service barrier further comprises means between said floor plate and said plurality of leaves to selectively retain said plurality of leaves in said extended position. Hence said leaves of said barrier are prevented from skewing if a force is applied thereto.

The service barrier may also comprise means between at least one pair of neighboring leaves in said extended position for securing said pair of neighboring leaves together.

Advantageously, said floor plate includes a grounding mat, thereby disposing of the need of a technician to wear a grounding strap during maintenance.

The service barrier maybe provided integral with said elevator equipment wherein said floor plate is pivotally mounted on a front wall of said elevator equipment and at least one of said plurality of hinged leaves is mounted on a side wall of said elevator equipment. The elevator equipment may be at least one of an electrical control cabinet, a drive cabinet, a power unit, a traction machine, a hydraulic control cabinet and a pump unit for an elevator.

Alternatively the service barrier maybe provided integral with a room for housing elevator equipment wherein said floor plate is pivotally mounted on a floor of said room and at least one of said plurality of hinged leaves is mounted to a wall of said room. Said room can be a dedicated room for said elevator equipment or conversely could be integrated within a shaft of said elevator. Preferably said room further comprises a lockable door selectively permitting access thereto.

The present invention also provides a method for creating a work space for maintenance of elevator equipment comprising the steps of providing a service barrier having a floor plate and a plurality of leaves hinged along vertical axes, moving said floor plate from a stored position in front of said elevator equipment to a substantially horizontal extended position, and folding out said plurality of hinged leaves from a stored position between said stored floor plate and said elevator equipment to an extended position on top of said extended floor plate thereby creating said work space.

Preferably said maintenance of said elevator equipment can only be performed after said workspace has been created.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which.

DETAILED DESCRIPTION OF THE PREFERRED EMBODIMENT

Figure 1:
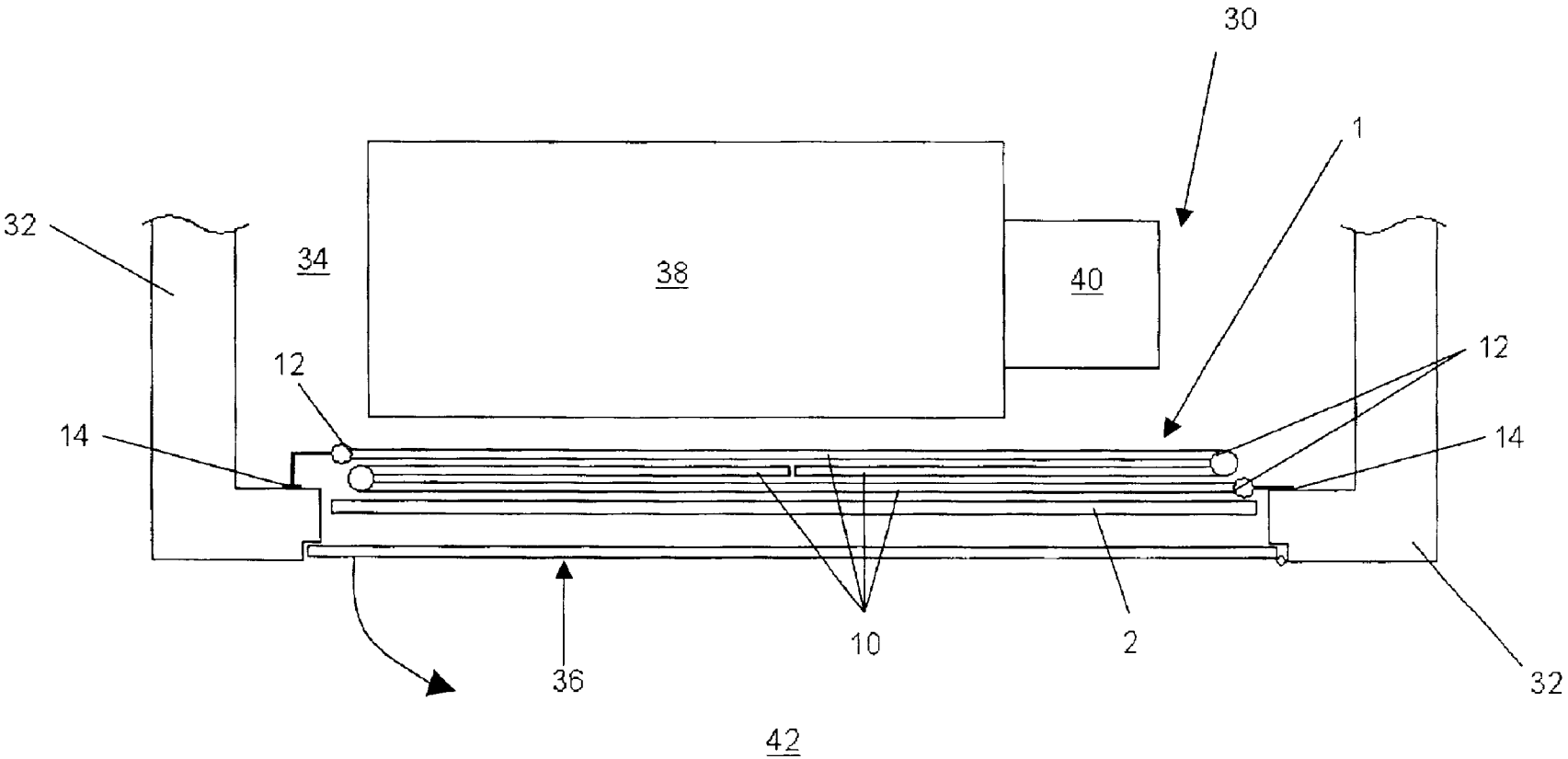
FIG. 1 is a top plan view of a room housing a control cabinet and a power unit for an elevator and a service barrier according to the present invention.

The general arrangement of a service barrier 1 in accordance with the present invention is illustrated in FIG. 1. The barrier 1 is located at an entrance between a hallway 42 and a closet 30 housing an electrical control cabinet 38 and power isolation unit 40 for an elevator. In the stored position of the barrier 1 as shown a technician is prevented from directly accessing the control cabinet 38 but can operate the power isolation unit 40 should an emergency condition arise. The closet 30 may be separate from a shaft of the elevator or alternatively could be integrated within the elevator shaft. In normal operating conditions the entrance to the closet 30 is secured by a lockable door 36.

The barrier 1 is mounted between the door 36 and the electrical control cabinet 38 and power isolation unit 40 by brackets 14 secured to side walls 32 of the closet 30. The barrier 1 further comprises a floor plate 2 fixed to a floor of the closet 30 about a pivot point 4 and a plurality of leaves 10 interconnected by vertically aligned, hinged posts 12.

When maintenance or repair involving access to the electrical control cabinet 38 is to be carried out, the technician unlocks and opens the door 36 from the hallway 42. The barrier 1 can then be extended to provide a workspace dimensioned according to the current standards. This procedure will be explained more fully with reference to FIGS. 2 and 3 which, for reasons of clarity, omit the lockable door 36.

Figure 2:
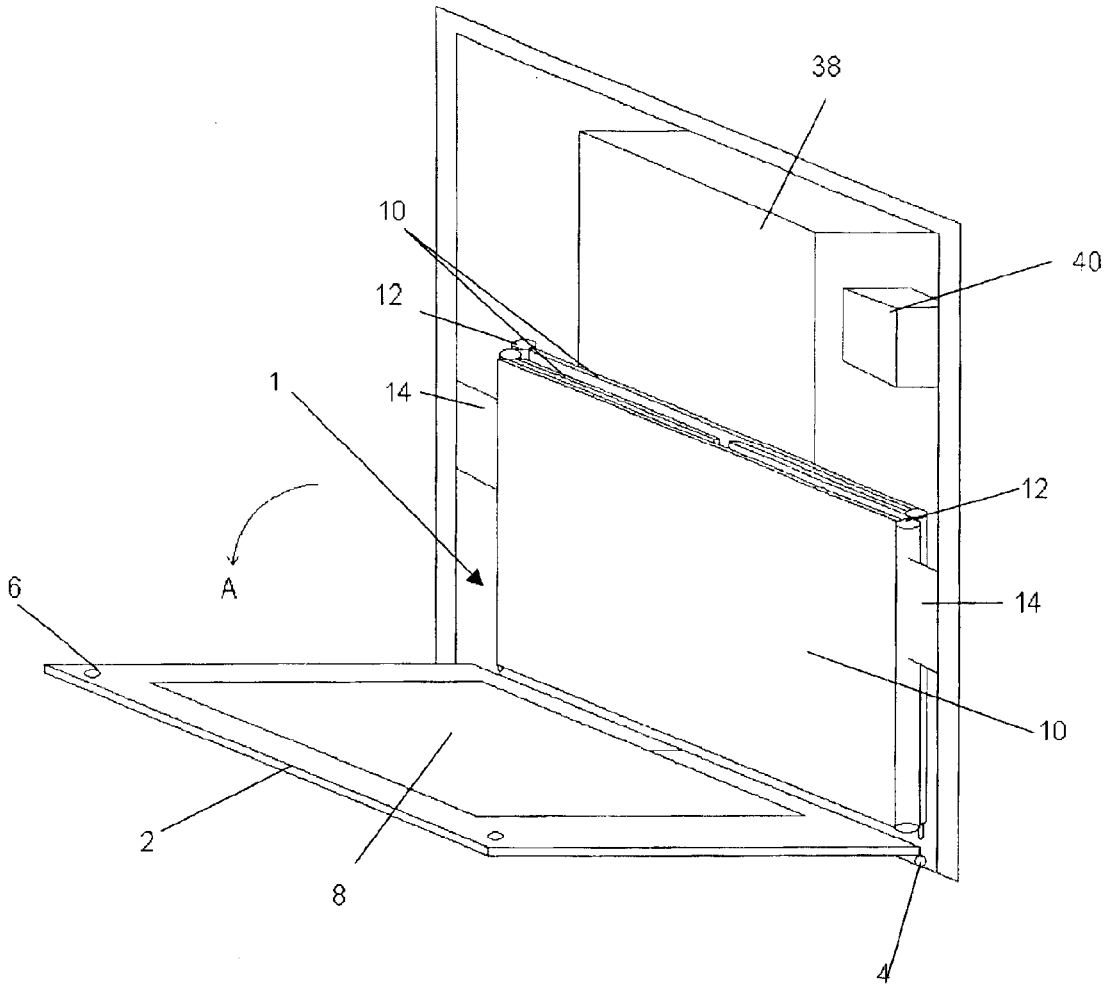
FIG. 2 is a perspective view of the room of FIG. 1 with the service barrier in a partially extended condition.

With the door 36 open the technician lowers the floor plate 2 about its pivot point 4 as indicated by arrow A in FIG. 2. The floor plate 2 incorporates a grounding mat 8 to earth the technician while working on the control cabinet 38.

Figure 3:
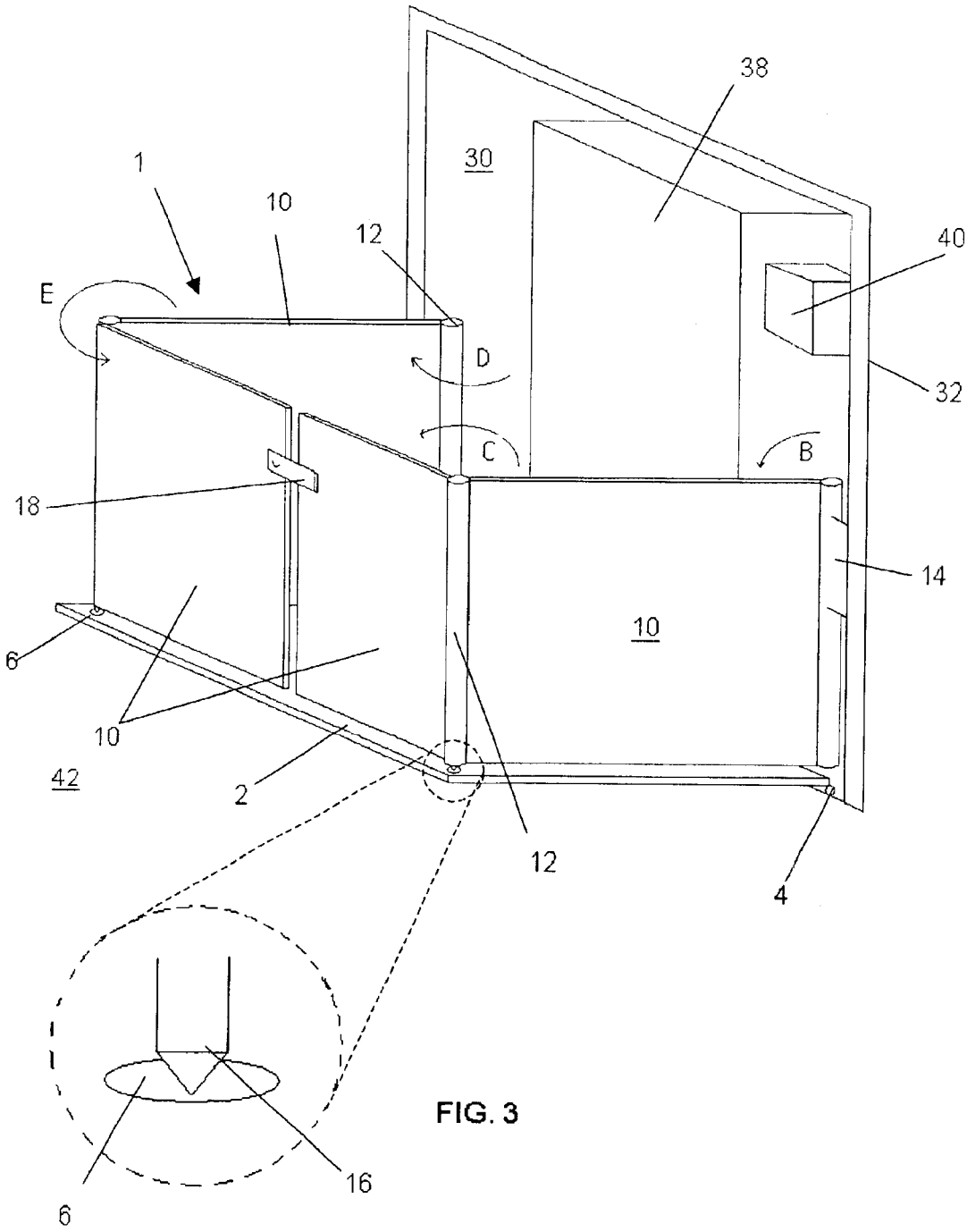
FIG. 3 corresponds to FIG. 2 but showing the service barrier in the fully extended condition.

Then the leaves 10 are unfolded about the hinged posts 12 sequentially as designated by arrows B, C, D and E in FIG. 3 to form the required barrier 1 around the workspace. The hinged posts 12 at the extremities of the barrier 1 are secured by the brackets 14 to the sidewalls 32 of the closet 30. Integrated spikes 16 extend from the base of the intermediate hinged posts 12 into indentations 6 provided in the floor plate 2 so as to locate and secure the barrier 1 in the extended position and to prevent the barrier from skewing if a force is applied thereto. Furthermore to improve the rigidity of the barrier 1, a latch 18 is provided to secure the intermediate leaves 10 together after the technician has positioned himself within the work space defined by the barrier 1 and the control cabinet 38. Obviously, the integrated spikes 16 can be replaced by retractable bolts.

The invention as described above is purely illustratively, it being understood that the same can be susceptible to many modifications and variants which yet remain within the scope of the appended claims. For example the barrier 1 need not be used solely for the maintenance of an electrical control cabinet 38 but could be used for the maintenance of a drive cabinet, a power unit or a traction machine for the elevator. Furthermore the barrier 1 is equally susceptible for use with equipment associated with a hydraulic elevator, such as a hydraulic control cabinet or a pump unit, rather than a traction elevator. Additionally the floor plate 2 could be mounted in its stored position on an inner surface of the landing door 36 rather than being mounted about the pivot point 4. With this particular arrangement a technician would remove the floor plate from the door 36, place it horizontally on the landing floor 42 in front of the folded leaves 10 and then, as in the illustrated embodiment, unfold the leaves 10 on top of the floor plate to create the necessary workspace.

It will be understood, in particular, that structural reversals or alternative positionings of the components or parts that together make up the barrier for the elevator equipment of the present invention are possible within the scope of the appended claims. For example the barrier need not be mounted to the closet containing the elevator equipment but could be mounted directly onto the equipment itself.

What is claimed:

1. A service barrier for elevator equipment comprising a floor plate and a plurality of leaves hinged along vertical axes, wherein said floor plate is movable from a stored position to a substantially horizontal extended position, and said plurality of hinged leaves fold out from a stored position between said stored floor plate and said elevator equipment to an extended position on top of said extended floor plate thereby establishing a space in front of said elevator equipment so as to permit maintenance work.

2. The service barrier of claim 1, wherein said floor plate is pivotally mounted in front of said elevator equipment and at least one of said plurality of leaves is mounted to a side of said elevator equipment.

3. The service barrier of claim 1, wherein said floor plate in said stored position prevents access to said elevator equipment.

4. The service barrier of claim 1, further comprising means between said floor plate and said plurality of leaves to selectively retain said plurality of leaves in said extended position.

5. The service barrier of claim 1, further comprising means between at least one pair of neighboring leaves in said extended position for securing said pair of neighboring leaves together.

6. The service barrier of claim 1, wherein said floor plate includes a grounding mat.

7. Elevator equipment partially defined by a front wall and two side walls, and having an integral service barrier, said integral service barrier comprising a floor plate and a plurality of leaves hinged along vertical axes, wherein said floor plate is movable from a stored position to a substantially horizontal extended position, and said plurality of hinged leaves fold out from a stored position between said stored floor plate and said elevator equipment to an extended position on top of said extended floor plate thereby establishing a space in front of said elevator equipment so as to permit maintenance work.

8. The elevator equipment of claim 7, wherein said floor plate is pivotally mounted on said front wall of said elevator equipment and at least one of said plurality of leaves is mounted on a side wall of said elevator equipment.

9. The elevator equipment of claim 7 being at least one of an electrical control cabinet, a drive cabinet, a power unit, a traction machine, a hydraulic control cabinet and a pump unit for an elevator.

10. An elevator installation comprising a room for housing elevator equipment defined by walls and a floor, wherein said room includes an integral service barrier, said integral service barrier comprising a floor plate and a plurality of leaves hinged along vertical axes, wherein said floor plate is movable from a stored position to a substantially horizontal extended position, and said plurality of hinged leaves fold out from a stored position between said stored floor plate and said elevator equipment to an extended position on top of said extended floor plate thereby establishing a space in front of said elevator equipment so as to permit maintenance work.

11. The elevator installation of claim 10, wherein said floor plate is pivotally mounted on said floor and at least one of said plurality of leaves is mounted to a wall of said room.

12. The elevator installation of claim 10 further comprising a shaft, wherein said room is integrated within said a shaft.

13. The elevator installation of claim 10, wherein said room further comprises a lockable door selectively permitting access thereto.

14. A method for creating a work space for maintenance of elevator equipment comprising the steps of:

providing a service barrier having a floor plate and a plurality of leaves hinged along vertical axes;

moving said floor plate from a stored position in front of said elevator equipment to a substantially horizontal extended position; and folding out said plurality of hinged leaves from a stored position between said stored floor plate and said elevator equipment to an extended position on top of said extended floor plate thereby creating said work space.

15. The method according to claim 14, wherein said floor plate is pivotable from said stored position to said extended position.

16. The method according to claim 14, wherein said maintenance of said elevator equipment can only be performed after said workspace has been created.

* * * * *